US008845284B2

(12) United States Patent
Farrell et al.

(10) Patent No.: US 8,845,284 B2
(45) Date of Patent: Sep. 30, 2014

(54) APPARATUS AND SYSTEM FOR SEALING A TURBINE ROTOR

(75) Inventors: Thomas Raymond Farrell, Simpsonville, SC (US); Gary Charles Liotta, Simpsonville, SC (US); Ian David Wilson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 395 days.

(21) Appl. No.: 12/829,632

(22) Filed: Jul. 2, 2010

(65) Prior Publication Data

US 2012/0003079 A1 Jan. 5, 2012

(51) Int. Cl.
*F01D 11/00* (2006.01)

(52) U.S. Cl.
CPC ..... *F01D 11/005* (2013.01); *F05D 2240/11* (2013.01); *F01D 11/001* (2013.01)
USPC ..... 415/173.7; 415/174.2; 415/174.5

(58) Field of Classification Search
USPC ..... 415/170.1, 173.1, 173.3, 173.5, 173.7, 415/174.5
See application file for complete search history.

(56) References Cited

U.S. PATENT DOCUMENTS

| | | | | |
|---|---|---|---|---|
| 3,551,068 | A * | 12/1970 | Allen et al. | 415/173.7 |
| 4,880,354 | A | 11/1989 | Teranishi et al. | |
| 5,833,244 | A | 11/1998 | Salt et al. | |
| 6,464,453 | B2 | 10/2002 | Toborg et al. | |
| 6,558,118 | B1 * | 5/2003 | Brisson et al. | 415/173.7 |
| 7,220,099 | B2 * | 5/2007 | Bekrenev et al. | 415/173.7 |
| 7,252,481 | B2 | 8/2007 | Stone | |
| 7,410,345 | B2 | 8/2008 | Bracken | |
| 7,488,153 | B2 | 2/2009 | Reigl | |
| 7,520,718 | B2 | 4/2009 | Engle | |
| 8,221,062 | B2 * | 7/2012 | Liotta et al. | 415/173.7 |
| 2003/0180141 | A1 | 9/2003 | Kress et al. | |
| 2005/0129525 | A1 | 6/2005 | Bekrenev et al. | |
| 2008/0008581 | A1 | 1/2008 | Pilecki | |
| 2008/0008582 | A1 | 1/2008 | Pickens et al. | |
| 2008/0050233 | A1 | 2/2008 | Steiger et al. | |
| 2008/0112793 | A1 | 5/2008 | Lee et al. | |
| 2008/0145216 | A1 | 6/2008 | Klasing et al. | |

(Continued)

FOREIGN PATENT DOCUMENTS

GB 2272946 A * 6/1994

OTHER PUBLICATIONS

Rusetskiy, et al. "Gas Turbine packages of average capacity: the aspects of development". Gas Turbo Technology. Issue 2, 2009. HTTP://www.gtt.ru/en.

*Primary Examiner* — Ned Landrum
*Assistant Examiner* — Justin Seabe
(74) *Attorney, Agent, or Firm* — Cantor Colburn LLP

(57) ABSTRACT

An apparatus for restricting fluid flow in a turbo-machine is disclosed. The apparatus includes: a first inter-stage sealing member configured to be located between a first rotating airfoil stage and a second rotating airfoil stage attached to a rotor shaft, the first inter-stage sealing member including a segmented structure that includes a plurality of segments forming a circumferential surface, the first inter-stage sealing member including: a first base portion including a securing mechanism configured to at least substantially radially and tangentially secure the inter-stage sealing member to an inter-stage support structure; a first axial retention mechanism; and a first axially extending sealing portion configured to be outwardly radially loaded against at least one of the first rotating airfoil stage and the second rotating airfoil stage.

14 Claims, 6 Drawing Sheets

(56) References Cited

U.S. PATENT DOCUMENTS

| | | | | |
|---|---|---|---|---|
| 2010/0074731 | A1* | 3/2010 | Wiebe et al. | 415/173.4 |
| 2010/0178160 | A1 | 7/2010 | Liotta et al. | |
| 2010/0196164 | A1 | 8/2010 | Liotta et al. | |
| 2010/0232938 | A1 | 9/2010 | Harris, Jr. et al. | |
| 2010/0232939 | A1 | 9/2010 | Piersall et al. | |
| 2010/0239432 | A1 | 9/2010 | Liang | |
| 2010/0254805 | A1 | 10/2010 | Garcia-Crespo et al. | |
| 2011/0163506 | A1 | 7/2011 | Hafner | |
| 2013/0186103 | A1 | 7/2013 | Jha et al. | |
| 2013/0189087 | A1 | 7/2013 | Spracher et al. | |
| 2013/0189097 | A1 | 7/2013 | Ziegler et al. | |

* cited by examiner

APPARATUS AND SYSTEM FOR SEALING A TURBINE ROTOR

BACKGROUND OF THE INVENTION

The subject matter disclosed herein relates to turbines and turbo-machinery, and more particularly, to inter-stage seals in such turbines.

Turbine components, especially in gas and steam turbine systems, may be directly exposed to high temperature fluids, and therefore require cooling to meet their useful life. For example, some of the compressor air is diverted from the combustion process for cooling rotor components of the turbine.

The main flow path of a turbine is designed to confine the main working fluid as it flows through the turbine. Turbine rotor structural components are generally provided with cooling fluid independent of the main working fluid flow to prevent ingestion of the main working fluid therein during operation, and should be shielded from direct exposure to these fluids. Sealing devices may be utilized to shield rotor components from leakage of the main working fluid driving the turbine, as well as to prevent cooling fluids from escaping with the main working fluid. Typical inter-stage sealing arrangements can reduce the efficiency and performance of turbines due to leakage. Leakages in inter-stage sealing can require an increase in the amount of parasitic fluid used for cooling. For example, various wheel spaces in gas turbine assemblies using typical inter-stage sealing arrangements can consume up to 50% of the total cooling air flow for cooling.

BRIEF DESCRIPTION OF THE INVENTION

According to one aspect of the invention, an apparatus for restricting fluid flow in a turbo-machine includes: a first inter-stage sealing member configured to be located between a first rotating airfoil stage and a second rotating airfoil stage attached to a rotor shaft, the first inter-stage sealing member including a segmented structure that includes a plurality of segments forming a circumferential surface, the first inter-stage sealing member including: a first base portion including a securing mechanism configured to at least substantially radially and tangentially secure the inter-stage sealing member to an inter-stage support structure; a first axial retention mechanism; and a first axially extending sealing portion configured to be outwardly radially loaded against at least one of the first rotating airfoil stage and the second rotating airfoil stage.

According to another aspect of the invention, a gas turbine system includes: a plurality of first turbine airfoils attached to a first rotatable rotor disk; a plurality of second turbine airfoils attached to a second rotatable rotor disk; a plurality of stationary radially extending turbine airfoils located axially between the first rotor disk and the second rotor disk; and a first inter-stage sealing member configured to be axially located between the plurality of first turbine airfoils and the plurality of second turbine airfoils, the first inter-stage sealing member including a segmented structure that includes a plurality of segments forming a circumferential surface, the first inter-stage sealing member including: a first base portion including a securing mechanism configured to at least substantially radially and tangentially secure the inter-stage sealing member to a support structure disposed axially between the plurality of first turbine airfoils and the plurality of second turbine airfoils; a first axial retention mechanism; and a first axially extending sealing portion configured to be outwardly radially loaded against at least one of the plurality of first turbine airfoils and the plurality of second turbine airfoils.

These and other advantages and features will become more apparent from the following description taken in conjunction with the drawings.

DETAILED DESCRIPTION OF THE INVENTION

Apparatuses, systems and methods are provided for inter-stage sealing in a turbine. In one embodiment, the apparatuses, systems and methods include an inter-stage sealing assembly including a plurality of sealing segments that are configured to be outwardly radially loaded against a surface of one or more rotating components of a turbine, such as a rotor disk or a bucket. In one embodiment, the sealing member is at last substantially radially and tangentially secured to a stationary support structure located between the rotating components by a securing mechanism such as an at least substantially axial dovetail or fir tree form connection. In one embodiment, the sealing member includes at least two sealing members that are axially retained relative to one another via a removable axial securing mechanism.

Figure 1:
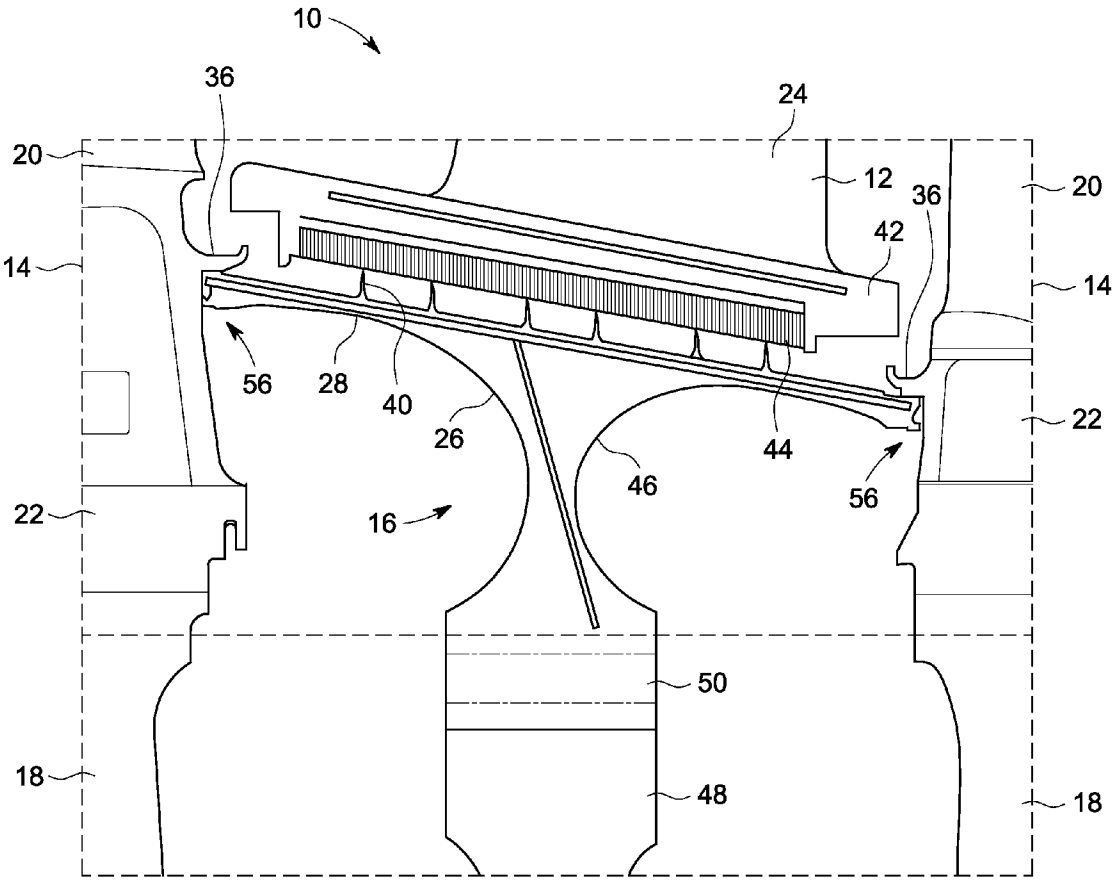
FIG. 1 is a side cross-sectional view of a portion of a turbine including a sealing assembly in accordance with an exemplary embodiment of the invention.

Referring to FIG. 1, a portion of a turbo-machine, such as a turbine, constructed in accordance with an exemplary embodiment of the invention is indicated generally at 10. The turbo-machine is described herein in an exemplary embodiment as a turbine, such as a gas or steam turbine, but may be any type of turbo-machine. The turbine 10 includes alternating inter-stage stationary airfoil stages 12 and rotating airfoil stages 14. In the embodiments described herein, the stationary airfoil stages 12 are described as including a plurality of nozzles 24, but may be any type of stationary airfoil such as a turbine nozzle and/or a turbine vane. In addition, in the embodiments described herein, the rotating airfoil stages 14 are described as including a plurality of buckets 20, but may be any type of rotating airfoil including buckets and/or blades. In one embodiment, the rotating airfoil stage includes at least one of: one or more buckets, blades or other airfoils; one or more airfoil bases or lower portions, such as airfoil shanks or platforms; and a rotating airfoil support such as a rotor disk. An inter-stage sealing apparatus or assembly 16 is disposed between successive rotating airfoil stages 14.

Each rotating airfoil stage 14 includes rotating components that include a rotor disk 18 or other rotating structure attached to a rotor shaft (not shown) that causes the rotor disks 18 to rotate about a central axis. A plurality of blades, airfoils or buckets 20 are removably attached to an outer periphery of each rotor disk 18 and extend radially outwardly from a rim of the rotor disk 18. The buckets 20 are attached by any suitable mechanism, such as an axially extending dovetail connection. In one embodiment, the buckets 20 or other airfoils each include a base or lower portion, such as a shank or platform 22 configured to attach to a corresponding rotor disk 18. The nozzle stage 12 includes a plurality of nozzles 24 that are connected to an outer casing assembly such as a turbine shell or an outer support ring attached thereto, and extend radially toward the central axis.

As used herein, an "axial" direction is a direction parallel to the central axis, and a "radial" direction is a direction extending perpendicular from the central axis. A "tangential direction" is a direction generally corresponding to a direction orthogonal to the central axis and generally parallel to a tangent of a circumference formed by a portion of the rotating airfoil stages 14. An "outer" location refers to a location in the radial direction that is farther away from the central axis than an "inner" location. "Outward" refers to a direction extending radially away from the central axis. Although the embodiments described herein are described with reference to the turbine section of a turbine, the embodiments may also be utilized in conjunction with various compression sections of a turbine.

An inter-stage sealing assembly 16 is included between the rotating components 14 and forms a rim seal or other airflow path shield. The sealing assembly 16 may form a rim or outer boundary of the turbine rotor that separates the main working fluid (such as combustion gas) flow path from interior portions of the turbine rotor (including components such as portions of the rotor shaft and the rotor disks 18). The sealing assembly 16 is configured to prevent fluids from migrating to or from the main working fluid flow path formed by the buckets 20 and the nozzles 24.

Figure 2:
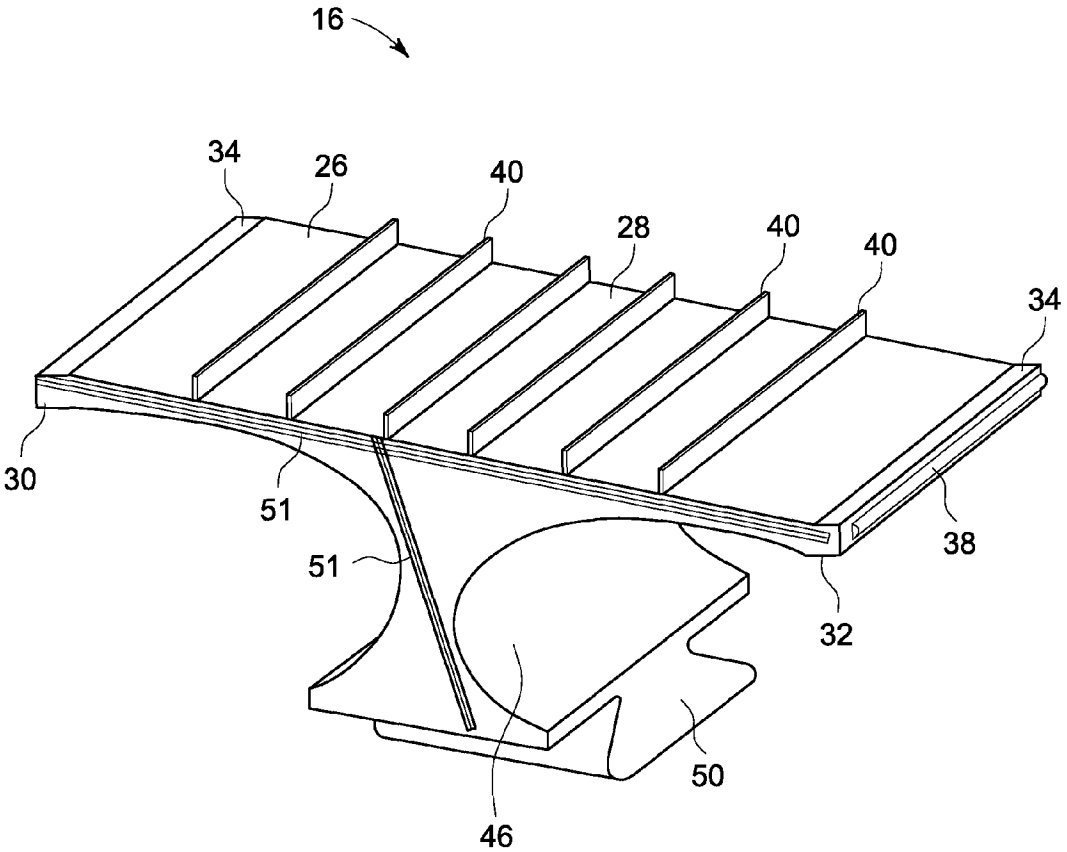
FIG. 2 is a perspective view of an embodiment of the sealing assembly of FIG. 1.

Referring to FIG. 2, in one embodiment, the sealing assembly 16 includes a segmented sealing member 26 that radially contacts and may be radially loaded against the rotating airfoil stages 14. The sealing member 26 includes one or more generally axially extending portions ("axial sealing portions" or "axially extending sealing portions") 28 having a forward end 30 and an aft end 32. As described herein, "forward" refers to a leading position relative to a reference position along a fluid flow path, and "aft" refers to a trailing position relative to a reference position along the fluid flow path. In one embodiment, the axial sealing portion 28 includes load surfaces 34 located at or proximate to the forward end 30 and the aft end 32 and configured to contact and exert an outward radial load against each rotating airfoil stage 14. For example, the load surfaces 34 are flat surfaces configured to contact axially protruding shelves 36 or other protrusions extending axially from the rotating airfoil stages 14. In the example shown in FIG. 1, the shelves 36 are disposed at the bucket shanks or platforms 22, although the shelves 36 may be disposed at any suitable location, such as at selected locations of the rotor disks 18 and the buckets 20. In one embodiment, a seal is formed by contact between the load surfaces 34 and the shelves 36, and/or a sealing mechanism, such as a load bar or a wire seal 38, is disposed at the forward end 30 and/or the aft end 32.

In one embodiment, the axial sealing portion 28 includes radial sealing members configured to contact a part of the stationary airfoil stage 12. For example, the axial sealing portion 28 includes a plurality of seal teeth 40 that are disposed on an outward side of the axial sealing portion 28 and extend radially outwardly. The seal teeth 40 are configured to seal against a stator surface of the stationary airfoil stage 12, for example, an inner nozzle support structure such as an inner platform 42 including an abradable surface 44.

The sealing member 26 includes a seal base 46 that is removably attachable to an inter-stage support structure such as a turbine spacer rim structure 48. In one embodiment, the seal base 46 includes a retention mechanism 50 configured to secure the sealing member 26 in place in at least substantially radial and tangential directions relative to the support structure 48, but allow for axial movement. The retention mechanism 50 is shown in FIGS. 1 and 2 as an at least substantially axial dovetail, although the retention mechanism is not so limited. The sealing member 26 is not limited to the shapes and configurations described herein, as the sealing member 26, the axial sealing portion 28, the retention mechanism 50, and/or the seal base 46 may be shaped as desired, for example, to reduce weight, deflection, leakage and/or stress.

In one embodiment, the sealing member 26 includes a plurality of sealing member segments 26 that are configured to be disposed against one another to form a continuous circumferential sealing member. Each of the sealing member segments 26 may include sealing features to control leakage around and through rim seal segments. Sealing features may include segment seals 51 such as generally axially and/or radially extending spline seals, wire seals or pin seals to form seals between adjacent segments 26 to lessen fluid flow therebetween.

Figure 3:
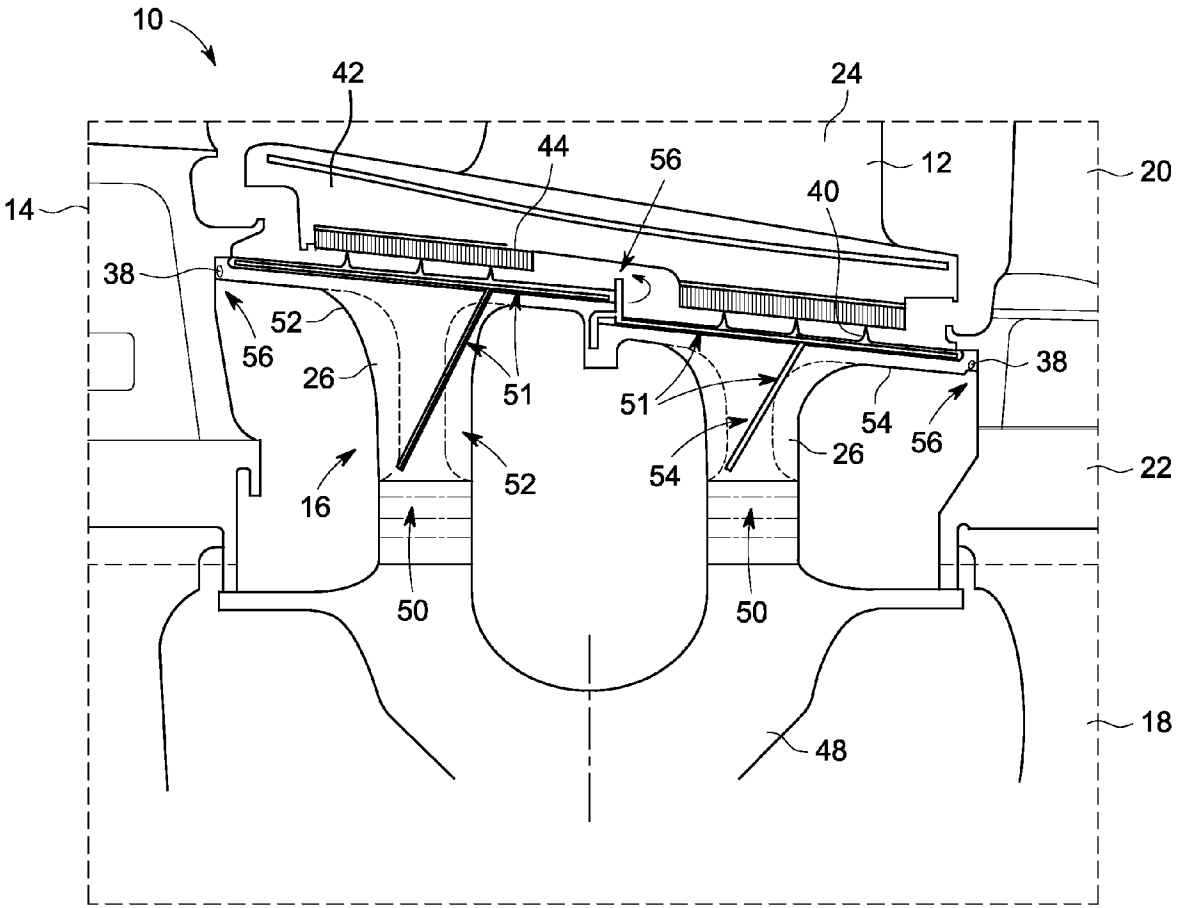
FIG. 3 is a side cross-sectional view of a portion of a turbine including a sealing assembly in accordance with an exemplary embodiment of the invention.

Referring to FIG. 3, in one embodiment, the sealing assembly 16 includes a plurality of sealing members 26 axially positioned relative to one another between the rotating airfoil stages 14. For example, the plurality of sealing members 26 include a forward sealing member 52 and an aft sealing member 54. The forward sealing member 52 is configured to be in radial contact with a rotating airfoil stage 14 at an up-stream end and in contact with the aft sealing member 54 at a down-stream end. Likewise, the aft sealing member 54 is configured to be in radial contact with a rotating airfoil stage 14 at a down-stream end and in contact with the forward sealing member 52 at an up-stream end.

In one embodiment, the sealing member 26, the forward sealing member 52 and/or the aft sealing member 54 includes an axial retention mechanism 56 configured to prevent axial movement of each sealing member 26, 52, 54 relative to the turbine stages 14. In one embodiment, the axial retention mechanism 56 includes a shear-loaded member configured to axially retain the forward sealing member 52 and the aft sealing member 54 relative to one another. The axial retention mechanism 56 may be held in place via a shear load, and may also be held in place via a radial and/or centrifugal load. In one embodiment, the axial retention mechanism 56 includes a removable and/or deformable member, such as a bend tab, attached to one of the sealing members 26, 52, 54 and configured to be deformed upon assembly to restrict axial movement. In the embodiment shown in FIG. 3, the bend tab 56 may be secured to the aft sealing member 54 and a portion of the bend tab 56 may be bent so that the portion extends radially and abuts an end of the forward sealing member 52. Other examples of the axial retention mechanism 56 may include pins, lock-bars, bolts, lock-wires and/or an axial load surface such as a surface of the bucket(s) 20 and/or the shank(s) or platform(s) 22. In one embodiment, the axial retention mechanism 56 is any member or device that is flexible and removable, and accessible from a radially external location, so that the axial retention mechanism 56 can be removed or otherwise disengaged without the need to remove components of the stationary airfoil stages 12 and the rotating airfoil stages 14.

Figure 4:
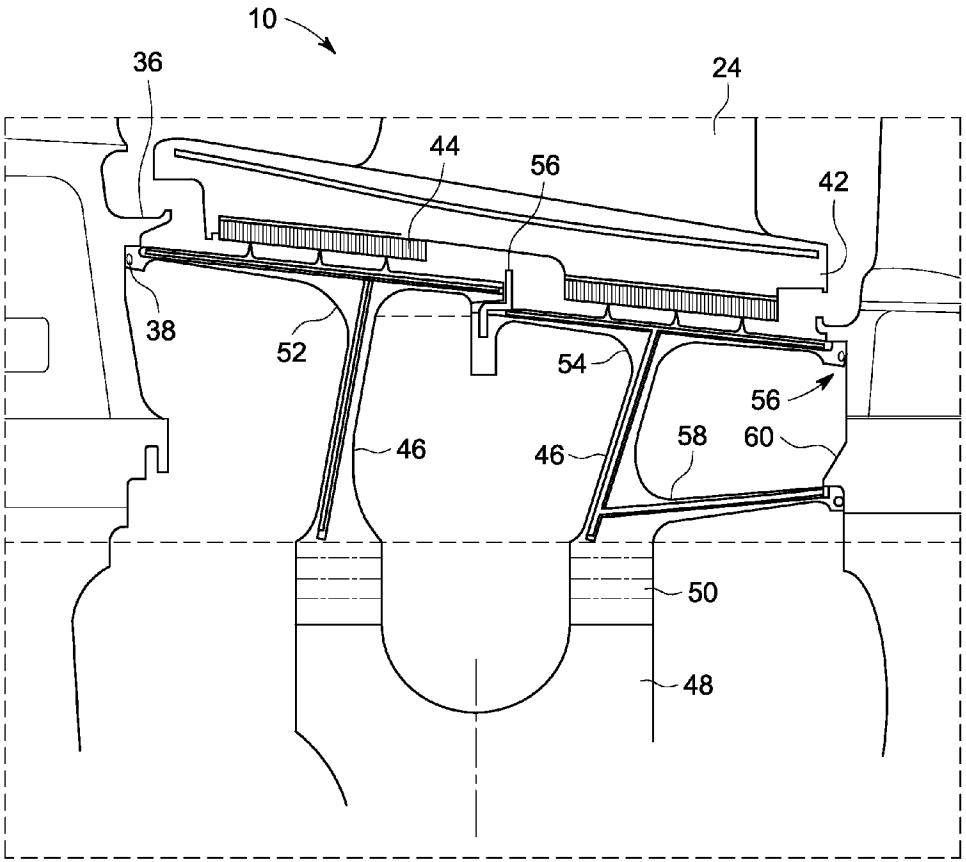
FIG. 4 is a side cross-sectional view of a portion of a turbine including a sealing assembly in accordance with an exemplary embodiment of the invention.
Figure 5:
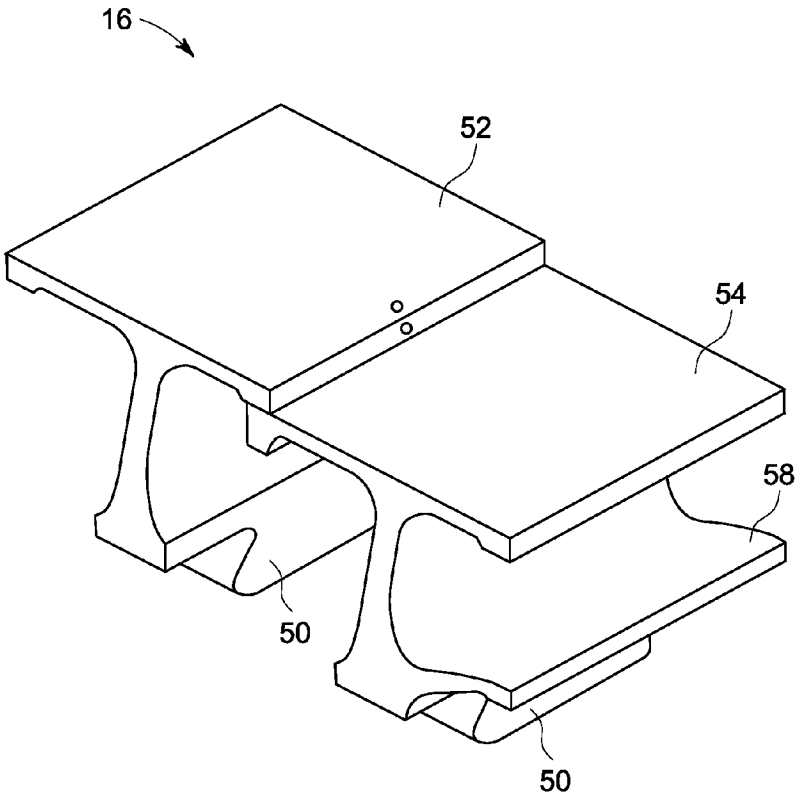
FIG. 5 is a perspective view of an embodiment of the sealing assembly of FIG. 4.

An alternative embodiment of the sealing members 26, 52, 54 is shown in FIGS. 4 and 5 that includes an additional axially extending member 58 configured to radially contact one or both rotating airfoil stages 14. The axially extending member 58 may extend from a sealing member 26, 52, 54, such as from the seal base 46, a base of the forward sealing member 52 and/or a base of the aft sealing member 54. In one embodiment, the rotating airfoil stage 14 includes an additional axially protruding shelf 60 configured to be radially loaded by the axially extending member 58.

The plurality of sealing members 26 may be assembled as part of the turbo-machine section 10 either before or after the rotating airfoil stages 14 and/or stationary airfoil stages 12 are assembled. For example, the sealing members 52, 54 may be assembled in a sequential order by first securing the aft sealing member 54 against a rotating airfoil stage 14 and contacting the shelf 36, then securing the forward sealing member 52 against the opposing rotating airfoil stage 14, and lastly engaging the axial retention mechanism 56.

Figure 6:
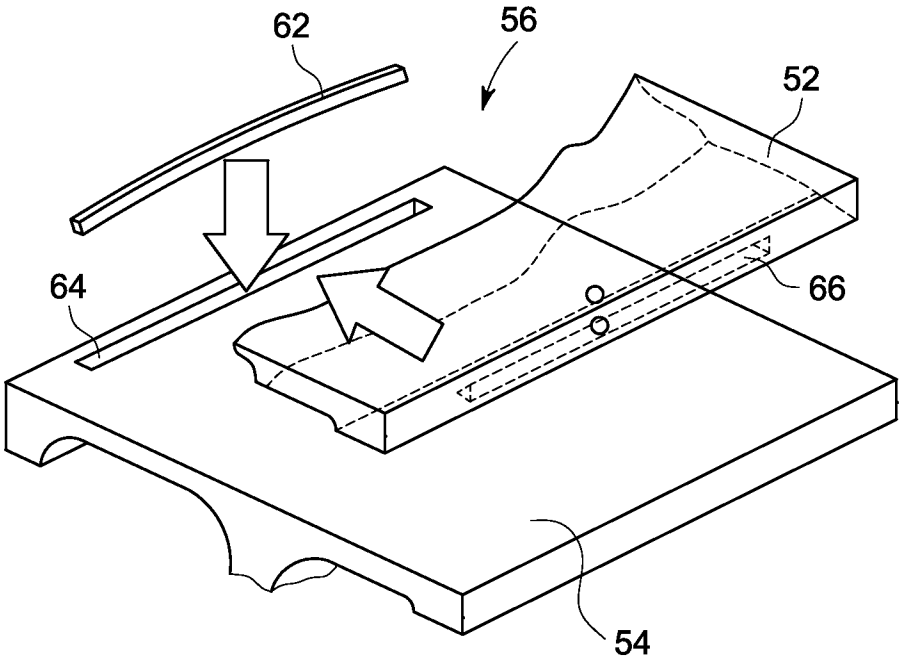
FIG. 6 is a perspective view of an embodiment of an axial retention mechanism of the sealing assembly of FIG. 5.

Referring to FIG. 6, an embodiment of the axial retention mechanism 56 includes a retention member 62 disposed at one of the sealing members 52, 54 and is configured to engage the other of the sealing members 52, 54 and restrict axial movement therebetween. For example, the aft sealing member 54 includes a first recess or slot 64 shaped to accept a lower portion of the retention member 62. In this example, the retention member 62 is a bar or other elongated member, and the slot 64 is elongated in a direction perpendicular to the axial direction. The forward sealing member 52 includes a second recess or slot 66 shaped to accept an upper portion of the retention member 62. Upon assembly, the retention member is partially disposed in both the first and second slots and acts to restrict axial movement of the sealing members 52, 54.

Although the systems and methods described herein are provided in conjunction with turbines, they may be used with any suitable type of turbine and/or turbo-machine. For example, the systems and methods described herein may be used with a gas turbine, a steam turbine or a turbine including both gas and steam generation.

The devices, systems and methods described herein provide numerous advantages over prior art systems. For example, the devices, systems and methods provide the technical effect of increasing efficiency and performance of the turbo-machine by, for example, substantial reduction in the consumption of leakage and purge secondary air by enabling use of higher temperature materials exposed to hot gases and employing improved rotor sealing. An additional technical effect includes allowing the inter-stage sealing assembly to be easily assembled or disassembled by segmentation of the sealing members, either prior to or after assembly of the nozzle and/or turbine stages. Furthermore, the sealing assembly may be field replaceable without the need for disassembling the turbine rotor, allowing for ease of maintenance of the turbine and components therein. This turbine rotor rim seal arrangement enables improved turbine performance by reduction in consumption of cooling fluid.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus for restricting fluid flow in a turbo-machine, the apparatus comprising:

a first sealing assembly configured to be located between a first rotating airfoil stage and a second rotating airfoil stage attached to a rotor shaft, the first sealing assembly including a segmented structure that includes a plurality of segments forming a circumferential surface, the first sealing assembly including:

a first base portion including a securing mechanism operative to at least substantially radially and tangentially secure the first sealing assembly to a first inter-stage support structure;

a first axial retention mechanism; and a first axially extending sealing portion having a load surface outwardly radially loaded against at least one of the first rotating airfoil stage and the second rotating airfoil stage, wherein a seal is formed by radial contact between the load surface and at least one of the first rotating airfoil stage and the second rotating airfoil stage;

a second sealing assembly configured to be located between the first and second rotating turbine stages, the second sealing assembly including:

a second base portion, the second base portion including the securing mechanism operative to radially and tangentially secure the second sealing assembly to a second inter-stage support structure;

a second axial retention mechanism; and a second axially extending sealing portion configured to be outwardly radially loaded against at least one of the first rotating turbine stage and the second rotating turbine stage, wherein a seal is formed by contact between the load surface and at least one of the first rotating airfoil stage and the second rotating airfoil stage; and a removable axial retention mechanism configured to axially secure the second sealing assembly to the first sealing assembly.

2. The apparatus of claim 1, wherein each of the first and second rotating airfoil stages includes an axially extending protrusion, and the first axially extending sealing portion is configured to contact the axially extending protrusion.

3. The apparatus of claim 2, wherein the axially extending protrusion is disposed on at least one of a rotor disk, at least one bucket platform and at least one bucket included in each of the first and second rotating airfoil stages.

4. The apparatus of claim 1, wherein the first axial retention mechanism includes at least one of a shear-loaded member and an axial load surface.

5. The apparatus of claim 1, wherein the securing mechanism is an at least substantially axial dovetail form connection.

6. The apparatus of claim 1, wherein the first axially extending sealing portion includes a first end configured to radially contact the first rotating airfoil stage and a second end configured to radially contact the second rotating airfoil stage.

7. The apparatus of claim 1, wherein the second axial retention mechanism and the removable axial retention mechanism include at least one of a shear-loaded member and an axial load surface.

8. The apparatus of claim 1, wherein the first axially extending sealing portion includes a first forward end configured to radially contact the first rotating airfoil stage and a first aft end, and the second axially extending sealing portion includes a second forward end configured to engage the first aft end via the second axial retention mechanism and a second aft end configured to radially contact the second rotating airfoil stage.

9. A gas turbine system comprising:

a plurality of first turbine airfoils attached to a first rotatable rotor disk;

a plurality of second turbine airfoils attached to a second rotatable rotor disk;

a plurality of stationary radially extending turbine airfoils located axially between the first rotor disk and the second rotor disk; and a first sealing assembly configured to be axially located between the plurality of first turbine airfoils and the plurality of second turbine airfoils, the first sealing assembly including a segmented structure that includes a plurality of segments forming a circumferential surface, the first sealing assembly including:

a first base portion including a securing mechanism operative to at least substantially radially and tangentially secure the first sealing assembly to a support structure disposed axially between the plurality of first turbine airfoils and the plurality of second turbine airfoils;

a first axial retention mechanism; and a first axially extending sealing portion having a load surface configured to radially contact and exert an outward radial load forming a seal against at least one of the plurality of first turbine airfoils and the plurality of second turbine airfoils;

a second sealing assembly configured to be axially located between the plurality of first turbine airfoils and the plurality of second turbine airfoils, the second sealing assembly including:

a second base portion including the securing mechanism operative to radially and tangentially secure the second sealing assembly to a support structure;

a second axial retention mechanism and a second axially extending sealing portion configured to contact and exert an outward radial load forming a seal against at least one of the plurality of first turbine airfoils and the plurality of second turbine airfoils; and a removable axial retention mechanism configured to axially secure the second sealing assembly to the first sealing assembly.

10. The system of claim 9, wherein each of the plurality of first turbine airfoils and the plurality of second turbine airfoils includes an axially extending protrusion, and the first axially extending sealing portion is configured to contact the axially extending protrusion.

11. The system of claim 9, wherein the securing mechanism is an at least substantially axial dovetail form connection.

12. The system of claim 9, wherein the first axially extending sealing portion includes a first end configured to radially contact at least one of the plurality of first turbine airfoils and a second end configured to radially contact at least one of the plurality of second turbine airfoils.

13. The system of claim 9, wherein the second axial retention mechanism and the removable axial retention mechanism include at least one of a shear-loaded member and an axial load surface.

14. The system of claim 9, wherein the first axially extending sealing portion includes a first forward end configured to radially contact at least one of the plurality of first turbine airfoils and a first aft end, and the second axially extending sealing portion includes a second forward end configured to engage the first aft end via the removable axial retention mechanism and a second aft end configured to radially contact at least one of the plurality of second turbine airfoils.

* * * * *